US006715692B2

(12) United States Patent
Peterson et al.

(10) Patent No.: US 6,715,692 B2
(45) Date of Patent: Apr. 6, 2004

(54) DISPENSING METHODS AND APPARATUS FOR AUTOMOBILE FINISH PRODUCTS

(75) Inventors: Ronald Peterson, Tucson, AZ (US); Patrick Secord, Tucson, AZ (US)

(73) Assignee: Ecolab Inc., St. Paul, MN (US)

( * ) Notice: Subject to any disclaimer, the term of this patent is extended or adjusted under 35 U.S.C. 154(b) by 28 days.

(21) Appl. No.: 09/795,653

(22) Filed: Feb. 28, 2001

(65) Prior Publication Data

US 2001/0038040 A1 Nov. 8, 2001

Related U.S. Application Data

(63) Continuation of application No. 09/594,267, filed on Jun. 15, 2000, now abandoned.
(60) Provisional application No. 60/140,561, filed on Jun. 23, 1999.

(51) Int. Cl.[7] ..... A62C 5/02
(52) U.S. Cl. ..... 239/8; 239/302; 239/303; 239/305; 239/346; 239/358; 239/373; 222/132
(58) Field of Search ..... 239/8, 302, 303, 239/304, 305, 306, 346, 358, 364, 365, 366, 367, 368, 369, 373, 290, 411; 222/132, 135

(56) References Cited

U.S. PATENT DOCUMENTS

| | | | | | |
|---|---|---|---|---|---|
| 2,657,097 | A | | 10/1953 | New | 299/86 |
| 2,813,751 | A | * | 11/1957 | Barrett | 239/306 |
| 3,055,596 | A | * | 9/1962 | Pope | 239/305 |
| 3,433,417 | A | | 3/1969 | Poppitz | 239/304 |
| 3,504,858 | A | | 4/1970 | Liddiard | 239/172 |
| 3,556,402 | A | | 1/1971 | Wolking | 239/130 |
| 3,680,786 | A | | 8/1972 | Levy | 239/146 |
| 3,891,149 | A | * | 6/1975 | Rendemonti | 239/304 |
| 4,113,182 | A | | 9/1978 | Brago | 239/304 |
| 4,791,694 | A | | 12/1988 | Itaya et al. | 15/97 R |
| 4,828,180 | A | | 5/1989 | Kristensen | 239/302 |
| 4,967,960 | A | | 11/1990 | Futrell | 239/148 |
| 5,044,520 | A | | 9/1991 | Moisan | 222/2 |
| 5,074,438 | A | * | 12/1991 | Ingram | 222/132 |
| 5,349,980 | A | | 9/1994 | Spiegel | 137/1 |
| 5,387,290 | A | | 2/1995 | Kolinsky | 134/32 |
| 5,389,149 | A | | 2/1995 | Carey et al. | 118/302 |
| 5,497,914 | A | * | 3/1996 | Maltsis | 222/185 |
| 5,611,485 | A | * | 3/1997 | Davis | 239/8 |
| 5,700,312 | A | | 12/1997 | Fausnight et al. | 106/10 |
| 5,957,329 | A | * | 9/1999 | Kenney et al. | 222/1 |

* cited by examiner

*Primary Examiner*—Robin O. Evans
(74) *Attorney, Agent, or Firm*—IPLM Group, P.A.

(57) ABSTRACT

A dispensing system includes at least one source of pressurized air and reservoirs for multiple automobile finish products. A discrete spray gun is provided for each of the products.

5 Claims, 4 Drawing Sheets

200
210
116
140
241
202
201
218
219
104

200
210
280
241
104

200
210
113
40
241
280
104
218
248
245
242
282
219

DISPENSING METHODS AND APPARATUS FOR AUTOMOBILE FINISH PRODUCTS

This application is a continuation of U.S. application Ser. No. 09/594,267 filed Jun. 15, 2000, entitled Dispensing Methods and Apparatus for Automobile Finished Products, now abandoned, and claims priority under 35 U.S.C. 119(e) from provisional patent application Serial No. 60/140,561 filed Jun. 23, 1999.

FIELD OF THE INVENTION

The present invention relates to the application of coating materials to outer surfaces on automobile components and more specifically, to methods and apparatus for dispensing such products.

BACKGROUND OF THE INVENTION

In the car wash industry, automobile appearance products or premium services may be applied in automated fashion inside the wash tunnel, or manually outside the wash tunnel. For example, such services include a tire dressing which adds a shine to the appearance of the tires, a water repellant which is applied to the windshield and perhaps the other windows, and a wax product which enhances and/or protects the paint finish. The "on-line" services, which are performed inside the tunnel, are considered advantageous because they require no manual labor and provide relatively consistent results. However, the "off-line" services, which are performed outside the tunnel, enjoy a higher perceived value in the minds of many consumers. These services involve the application of a liquid to the automobile surface to be treated. The product is then spread across the surface, and then it is typically buffed off the surface after some time has elapsed. As suggested by a comparison of the foregoing methods, a need remains for improved "off-line" services which are less labor intensive and/or less time consuming.

SUMMARY OF THE INVENTION

One aspect of the present invention is to atomize the automobile appearance products during application to the surface being treated. The resulting fog applies the product more evenly and up to ten times faster. Also, the fogged product may be more readily removed than products applied in traditional fashion. A single source of pressurized air may be placed in communication with several different treatment products and associated spray guns to provide a self-contained, full service system. Many of the features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
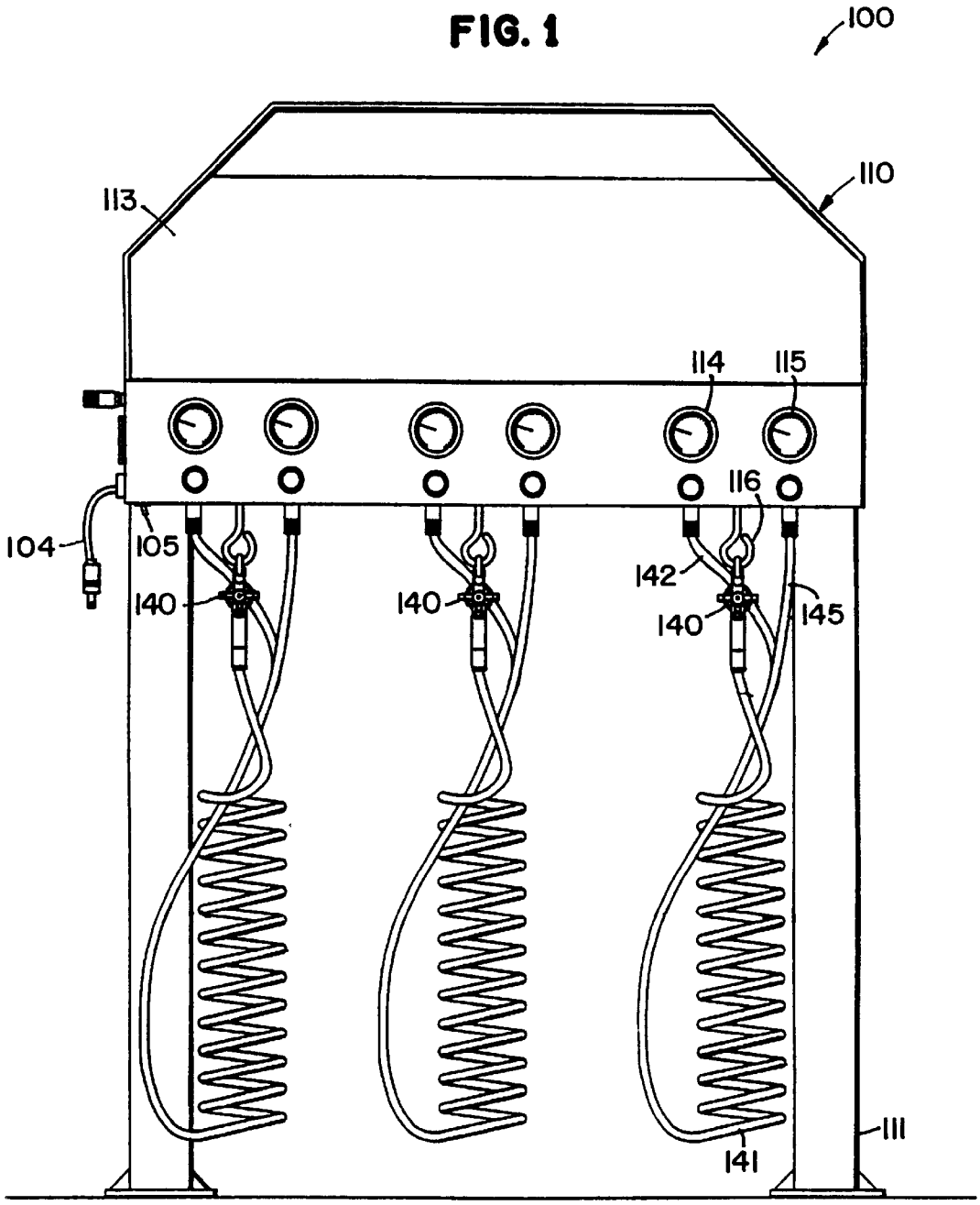
FIG. 1 is a front view of a first coating system constructed according to the principles of the present invention.
Figure 2:
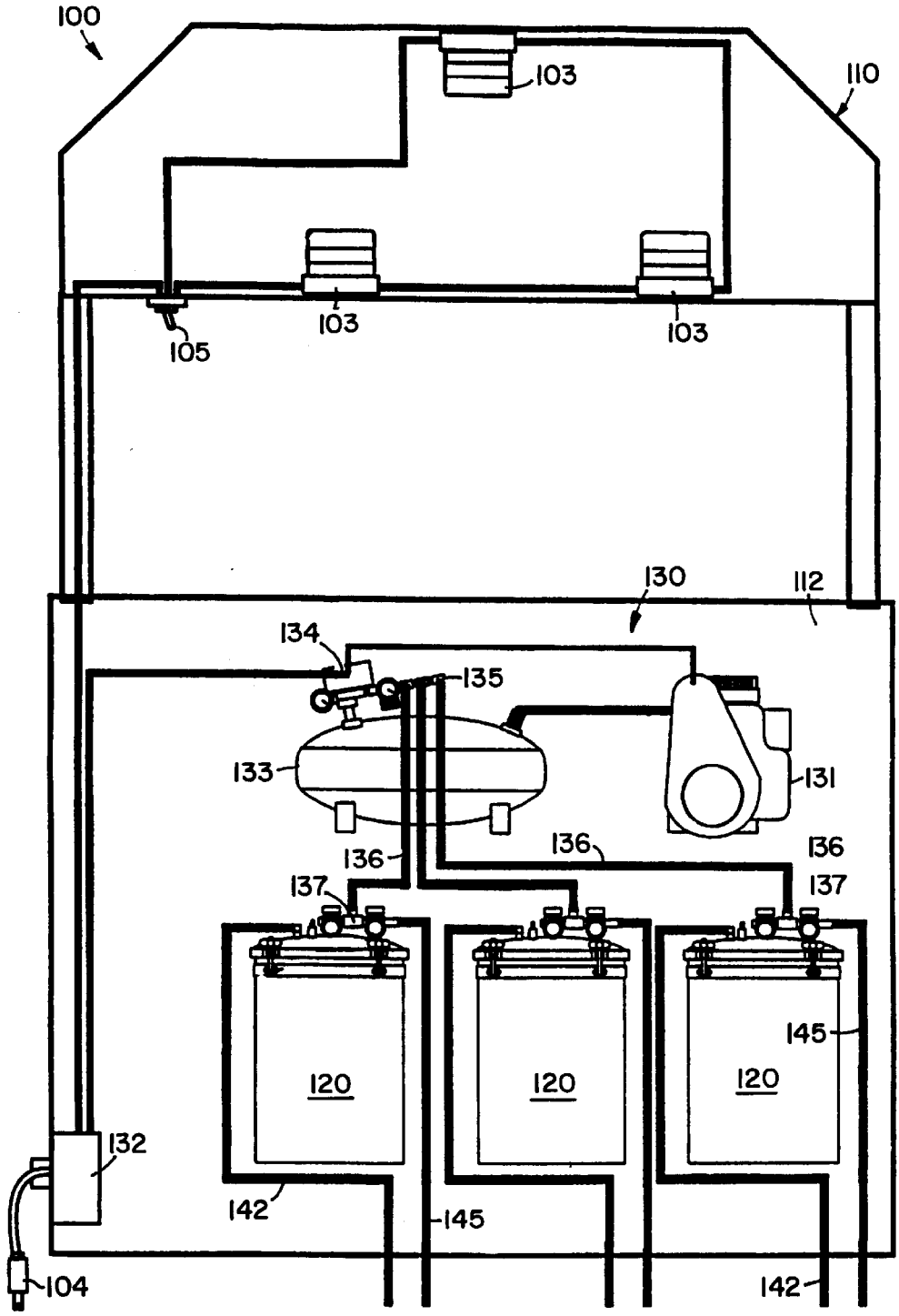
FIG. 2 is a diagrammatic view of the system of FIG. 1.
Figures 3, 4, 5:
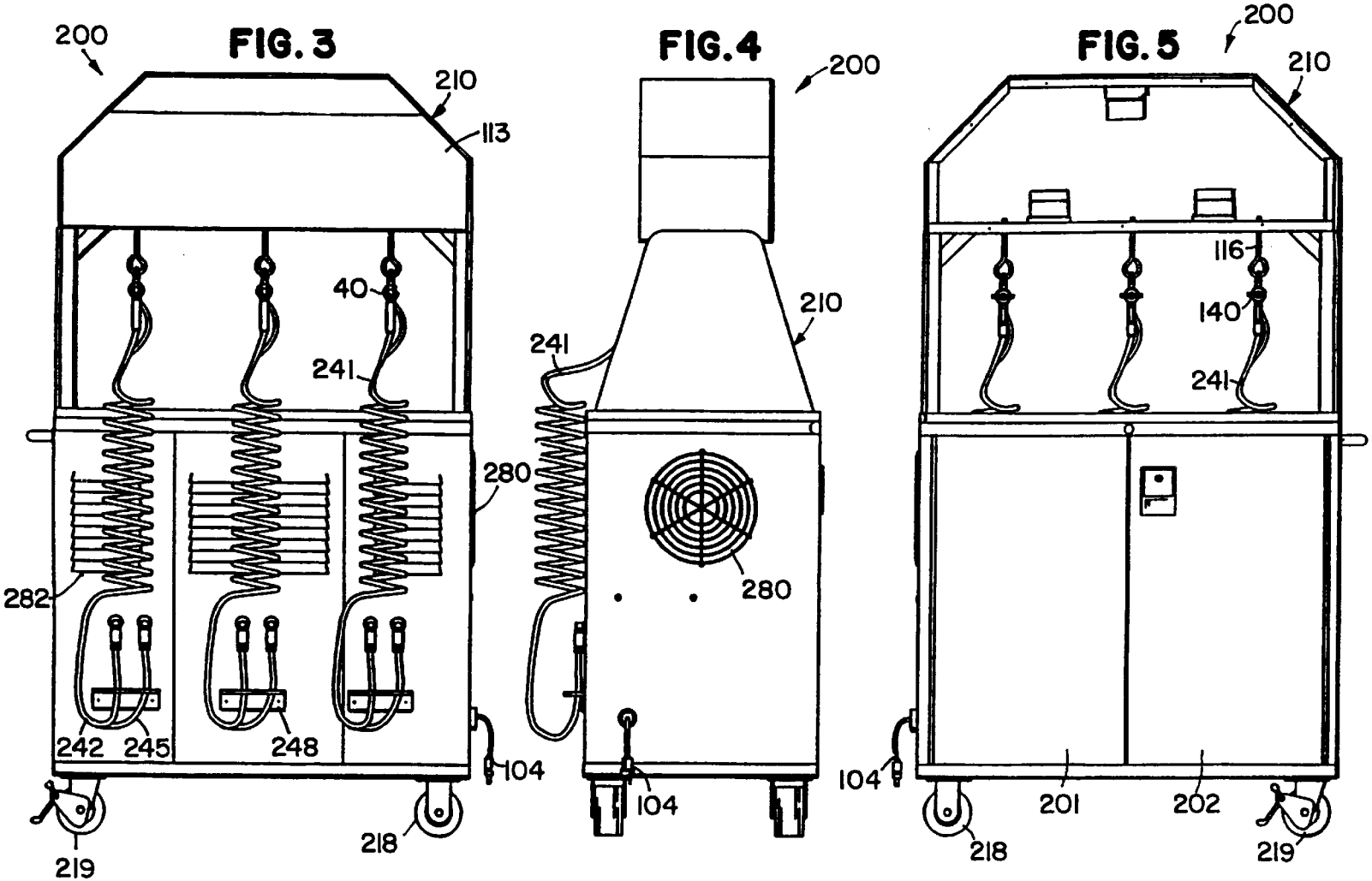
FIG. 3 is a front view of a second system constructed according to the principles of the present invention.
FIG. 4 is a side view of the system of FIG. 3.
FIG. 5 is a rear view of the system of FIG. 3.
Figure 6:
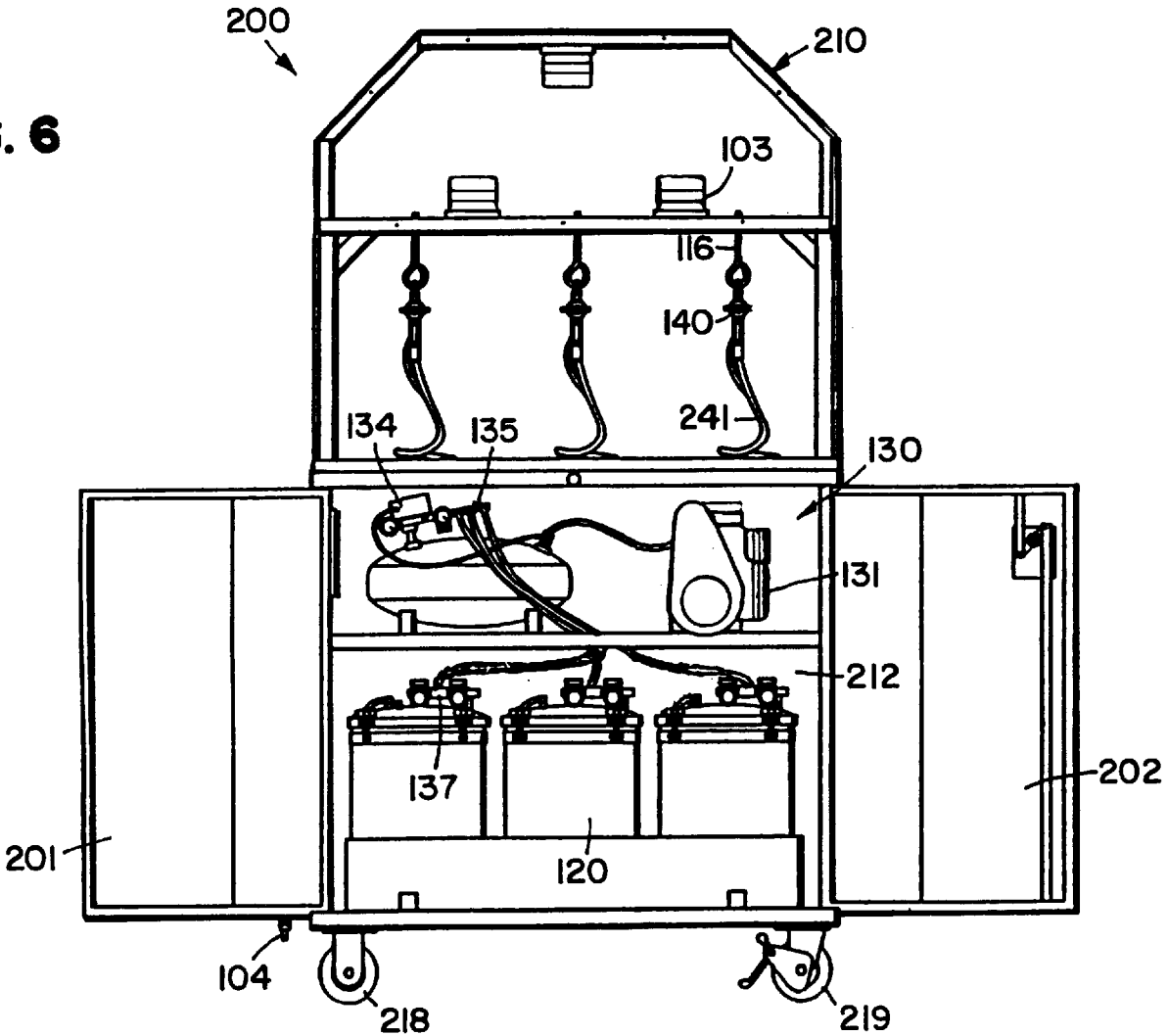
FIG. 6 is a rear view of the system of FIG. 3 with rear doors open.

A first embodiment of the present invention is designated as 100 in FIGS. 1–2. The embodiment 100 may be described as a self-contained coating system designed to apply different types of finish products to outer surfaces on respective automobile components. The depicted embodiment 100 selectively dispenses a treatment for the tires, a wax for the paint finish, and a water repellant for the windshield.

The apparatus 100 generally includes a housing or base 110, a separate tank 120 for each of the coating materials, a pressurized air source 130 in communication with each of the tanks, a separate spray gun 140 for each of the tanks 120, wherein the pressurized air source 130 is also in direct communication with each of the spray guns 140.

The base 110 may be described as a stationary cabinet having downwardly extending legs 111 which rest upon a horizontal floor surface. The base 110 has a rearwardly accessible compartment 112 (shown in FIG. 2) and a forwardly facing display or facade 113 (shown in FIG. 1). Commercial names for the three coating materials are prominently displayed on the facade 113. For reasons discussed below, pressure gauges 114 and 115 are mounted on the base 110 beneath the product names and are visible from the front of the apparatus 100. The base 110 further includes three laterally spaced hooks 116 which extend downward beneath the gauges 114 and 115, and support respective spray guns 140.

Both the construction and the operation of the guns 140 are known in the art. In particular, the guns 140 are Binks MODEL 2001 spray guns sold by Binks Sames Corporation, an Illinois Tool Works Company having a place of business in Franklin Park, Ill. Although this particular type of spray gun 140 is well suited for the present invention, those skilled in the art will recognize that the scope of the present invention is not limited in this regard.

Each of the spray guns 140 is connected to a respective tank 120 and the pressurized air source 130 by means of a two-line hose 141 having discrete tubes 142 and 145. Each of the tubes 142 supplies one of the pressurized materials to a respective spray gun 140, and each of the tubes 145 supplies compressed air directly to a respective spray gun 140. The hoses 141 are also known in the art and commercially available. More specifically, they are Type ATP-38 polyurethane hoses sold by Advanced Technology Products of Milford Center, Ohio. The ends of the discrete tubes 142 and 145 are separated from one another to facilitate connection to respective ports or valves, but the intermediate portions of respective tubes 142 and 145 are connected to one another or otherwise bundled together.

The pressure gauges 114 are placed in communication with respective storage tanks 120, and each gauge 114 indicates the pressure within a respective tank 120. The desired amount of pressure is a function of the viscosity of the material within the tank 120. For example, the Black Magic tire dressing (dispensed from the left side spray gun 140 in FIG. 1) should be pressurized in the range of 20 psi to 30 psi; the RainX windshield water repellant (dispensed from the middle spray gun 140 in FIG. 1) should be pressurized to no more than 10 psi; and the Blue Coral Express Wax (dispensed from the right side spray gun 140 in FIG. 1) should be pressurized in the range of 25 psi to 40 psi. Each of the materials in the tanks 120 is commercially available from Blue Coral Systems, Inc. of Tucson, Ariz. U.S. Pat. No. 5,700,312, which is incorporated herein by reference, also discloses a finish product suitable for use with the present invention.

As shown diagrammatically in FIG. 2, the pressurized air source 130 includes a compressor 131 which is connected to a power source 132 and placed in fluid communication with an air storage tank 133. Upon receiving power and/or a control signal, the compressor 131 conveys pressurized air to the air storage tank 133. A pressure regulator 134 is also connected to a power source 132 and placed in fluid communication with the air storage tank 133. The pressure regulator 134 controls operation of the compressor 131 to maintain desired pressure in the air storage tank 133.

The pressure regulator 134 is also placed in fluid communication with a manifold 135 having three output lines 136. Each of the outlet lines 136 is placed in fluid communication with a discrete splitter or T-junction 137 associated with a respective material storage tank 120. Each splitter 137 has a first port in fluid communication with a respective material storage tank 120, and a second port in fluid communication with a respective spray gun 140 (by means of a respective tube 145). Each material storage tank 120 is also placed in fluid communication with a respective spray gun 140 (by means of a respective tube 142). Each of the product lines or tubes 145 delivers pressurized product to a respective spray gun 140, and each of the air lines or tubes 145 delivers pressurized air to a respective spray gun 140 for purposes of atomizing the product. Each of the pressure gauges 115 on the front of the base 110 indicates the air pressure within a respective air line or tube 145. The air pressure within the air storage tank 133 is preferably maintained between 80 and 120 psi.

On the embodiment 100, the display 113 includes strobe lights 103 for purposes of highlighting the available products and/or providing a visual indication of which material is currently being dispensed. For purposes of the lights 103, as well as the compressor 131 and the regulator 134, a plug 104 is provided on the base 110 to place the appropriate components in communication with a source of electricity, and a switch 105 is provided on the base 110 to selectively provide power to such components.

FIGS. 3–6 show a second embodiment 200 of the present invention. As suggested by the like reference numerals, the second embodiment 200 is similar in certain respects to the first embodiment 100. The base 210 includes a similar display 113 and a discrete cabinet portion 212 which is accessible via hinged doors 201 and 202. Caster wheels 218 and 219 are mounted on the bottom of the base 210 to facilitate portability of the unit 200. Locks are provided on the wheels 219 to selectively resist rotation of same.

A similar pressurized air source 130 and similar spraying arrangements are provided on the apparatus 200. The hoses 241 are similar in construction to the hoses 141 but are arranged somewhat differently and thus, are identified by discrete reference numerals. Brackets 248 are provided on the front of the base 210 to support the individual hose tubes 242 and 245 in desired fashion. The base 210 is also provided with a cooling fan 280 and air intake vents 282.

The second embodiment 200 operates in much the same manner as the first embodiment 100 to apply atomized finish products to automobile surfaces. The service is not only more convenient to apply, but also tends to provide better results.

The foregoing description and accompanying figures are limited to specific embodiments and particular applications of the present invention. However, those skilled in the art may recognize additional variations and/or modifications which incorporate the essence of the present invention. Accordingly, the scope of the present invention is to be limited only to the extent of any issued patent claims.

Those skilled in the art will also recognize that the present invention may be described in terms of various methods. For example, the present invention provides a method of dispensing an automobile coating product, comprising the steps of (a) placing a first pressurized air source in fluid communication with a storage tank containing the coating product; (b) placing the storage tank in fluid communication with a spray gun; (c) placing a second pressurized air source in direct fluid communication with the spray gun; (d) introducing pressurized air into the storage tank in order to convey a desired amount of the coating product to the spray gun; (e) conveying pressurized air directly to the spray gun in order to facilitate dispensation of the coating product in atomized form.

The foregoing method may include the additional steps of (a) providing a second spray gun and a second storage tank for a second coating product; and performing the foregoing steps (b)–(e) with respect to the second storage tank, using common pressurized air sources. Additionally, all of the pressurized air may be provided by a single source, and/or a lighted display may indicate which coating product is currently being dispensed. The method may be further refined to provide discrete air pressures to the different storage tanks and/or the different spray guns. Also, the system components may be provided on either a wheeled cart or a stationary base.

The present invention may also be described in terms of a spraying system, comprising a spray gun; a means for supplying a coating product to the spray gun; and a means for atomizing the coating product as it exits the spray gun. The supplying means may include a product storage tank interconnected between the spray gun and a source of pressurized air. The atomizing means may include a discrete line extending directly between the spray gun and the source of pressurized air.

The present invention may also be described in terms of an apparatus for applying an automobile appearance product, comprising (a) an air compressor; (b) a storage tank for the automobile appearance product; (c) a spray gun; (d) a product line interconnected between the storage tank and the spray gun; (e) a first air line interconnected between the air compressor and the storage tank, in order to pressurize the product in both the storage tank and the product line; and (f) a second air line interconnected between the air compressor and the spray gun, in order to atomize the product delivered by the product line. An air storage tank and/or a pressure regulator may be disposed between the air compressor and the air lines.

What is claimed is:

1. A method of dispensing an automobile finish product, comprising the steps of:

(a) operatively connecting a pressurized air source to a storage tank containing the finish product;

(b) operatively connecting the storage tank to a spray gun;

(c) operatively connecting a pressurized air source directly to the spray gun;

(d) conveying pressurized air to the storage tank to convey a desired amount of the finish product to the spray gun;

(e) conveying pressurized air directly to the spray gun to facilitate dispensation of the finish product in atomized form;

(f) washing the exterior surface of an automobile; and (g) subsequently dispensing the finish product from a position proximate an exit of a tunnel of a car wash on to exterior surface of an automobile after the automobile has gone through a tunnel of an in-line car wash.

2. The method of claim 1, further comprising the steps of providing a second said spray gun and a second said storage tank for a second finish product; and performing the foregoing steps (a)–(e) with respect to the second storage tank and the second spray gun.

3. The method of claim 2, wherein all of the pressurized air is provided by a single source.

4. The method of claim 2, further comprising the step of providing a lighted display to indicate which said finish product is currently being dispensed.

5. The method of claim 2, wherein each said finish product is selected from the group consisting of; a tire treatment; a paint treatment; and a windshield treatment.

* * * * *